US008448622B2

(12) United States Patent
Raasch

(10) Patent No.: US 8,448,622 B2
(45) Date of Patent: May 28, 2013

(54) CHOKE AND PRIMING SYSTEM FOR AN INTERNAL COMBUSTION ENGINE

(75) Inventor: Jason Raasch, Cedarburg, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 655 days.

(21) Appl. No.: 12/535,215

(22) Filed: Aug. 4, 2009

(65) Prior Publication Data

US 2011/0030640 A1 Feb. 10, 2011

(51) Int. Cl.

| | |
|---|---|
| ***F02N 99/008*** | (2006.01) |
| ***F02D 9/107*** | (2006.01) |
| ***F02M 1/04*** | (2006.01) |
| ***F02M 5/08*** | (2006.01) |

(52) U.S. Cl.

USPC ..... 123/179.9; 123/337; 261/39.5; 261/41.5; 261/42

(58) Field of Classification Search

USPC ..... 123/179.9, 185.2, 337; 261/39.5, 261/39.2, 39.4, 43, 42

See application file for complete search history.

(56) References Cited

U.S. PATENT DOCUMENTS

| | | | | |
|---|---|---|---|---|
| 1,917,591 | A * | 7/1933 | Kirby | 261/130 |
| 2,094,165 | A * | 9/1937 | Bicknell | 261/39.4 |
| 2,215,682 | A * | 9/1940 | Winkler | 261/39.3 |
| 2,563,645 | A * | 8/1951 | Ericson | 123/179.18 |
| 2,744,736 | A * | 5/1956 | Evinrude | 261/34.2 |
| 4,814,114 | A | 3/1989 | Charmley | |
| 6,012,420 | A * | 1/2000 | Dykstra et al. | 123/179.18 |
| 6,135,429 | A | 10/2000 | Woody | |
| 6,145,487 | A * | 11/2000 | Dykstra et al. | 123/179.18 |
| 6,523,809 | B2 | 2/2003 | Woody | |
| 6,622,992 | B2 * | 9/2003 | Woody | 261/35 |
| 6,866,019 | B1 * | 3/2005 | Schmitz | 123/344 |
| 6,915,772 | B2 * | 7/2005 | Carpenter | 123/179.12 |
| 6,990,969 | B2 | 1/2006 | Roth et al. | |
| 7,267,326 | B2 | 9/2007 | Dedering | |
| 2001/0032601 | A1 * | 10/2001 | Galka et al. | 123/73 A |
| 2009/0044777 | A1 * | 2/2009 | Clouse et al. | 123/179.18 |

* cited by examiner

*Primary Examiner* — Stephen K Cronin
*Assistant Examiner* — Raza Najmuddin
(74) *Attorney, Agent, or Firm* — Michael Best & Friedrich LLP

(57) ABSTRACT

An internal combustion engine that includes a carburetor having a choke valve and an actuator configured to move the choke valve between a closed choke position and an open choke position. A passageway is configured to direct a pressure pulse from the engine into a fuel chamber of the carburetor. The engine further includes a priming valve at least partially located within the passageway. The priming valve is configured to move between an open primer position that allows the pressure pulse to enter the fuel chamber through the passageway and a closed primer position that substantially restricts the pressure pulse from entering the fuel chamber through the passageway. The priming valve is configured to move between the open primer position and the closed primer position by the actuator when the actuator moves the choke valve between the closed choke position and the open choke position, respectively.

25 Claims, 6 Drawing Sheets

CHOKE AND PRIMING SYSTEM FOR AN INTERNAL COMBUSTION ENGINE

BACKGROUND

The present invention relates to internal combustion engines, and to choke and priming systems for internal combustion engines.

Internal combustion engines utilizing a carburetor, such as those engines in a lawnmower, a snowblower, or other outdoor power equipment, may include a choke assembly. The choke assembly typically includes a choke valve that is located in an intake of the carburetor. The choke valve can be operated manually or automatically to adjust fuel-air mixture in an intake of the engine. Particularly, during a cold start of the engine, the choke valve is closed in order to enrich the fuel-air mixture, which assists with starting the engine.

Internal combustion engines may also include a primer to assist with starting the engine. The primer is used to pressurize a fuel bowl of the carburetor. By pressuring the fuel bowl, more fuel is transferred from the bowl to the air intake of the carburetor, which also enriches the fuel-air mixture to assist with starting the engine.

SUMMARY

In one embodiment, the invention provides an internal combustion engine that includes a cylinder and a piston configured to reciprocate in the cylinder to generate a pressure pulse. The engine further includes a carburetor having an air intake, a fuel chamber in fluid communication with the air intake, a choke valve disposed in the air intake, and an actuator configured to move the choke valve between a closed choke position and an open choke position. A passageway is configured to direct the pressure pulse into the fuel chamber of the carburetor. The engine further includes a priming valve at least partially located within the passageway. The priming valve is configured to move between an open primer position that allows the pressure pulse to enter the fuel chamber through the passageway and a closed primer position that substantially restricts the pressure pulse from entering the fuel chamber through the passageway. The priming valve is configured to move between the open primer position and the closed primer position by the actuator when the actuator moves the choke valve between the closed choke position and the open choke position, respectively.

In another embodiment, the invention provides a carburetor for use with an internal combustion engine having a cylinder and a piston configured to reciprocate in the cylinder to generate a pressure pulse. The carburetor includes a body portion that at least partially defines an air intake, a fuel chamber in fluid communication with the air intake, and a passageway configured to direct the pressure pulse toward the fuel chamber of the carburetor. A choke valve is disposed in the air intake, and the choke valve is configured to move between a closed choke position to restrict air flow through the air intake and an open choke position to increase air flow through the air intake relative to the closed choke position. A priming valve is at least partially located within the passageway, and the priming valve is configured to move between an open primer position that allows the pressure pulse to enter the fuel chamber through the passageway and a closed primer position that substantially restricts the pressure pulse from entering the fuel chamber through the passageway. The priming valve is coupled to the choke valve for movement with the choke valve such that movement of the choke valve between the closed choke position and the open choke position moves the priming valve between the open primer position and the closed primer position, respectively.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
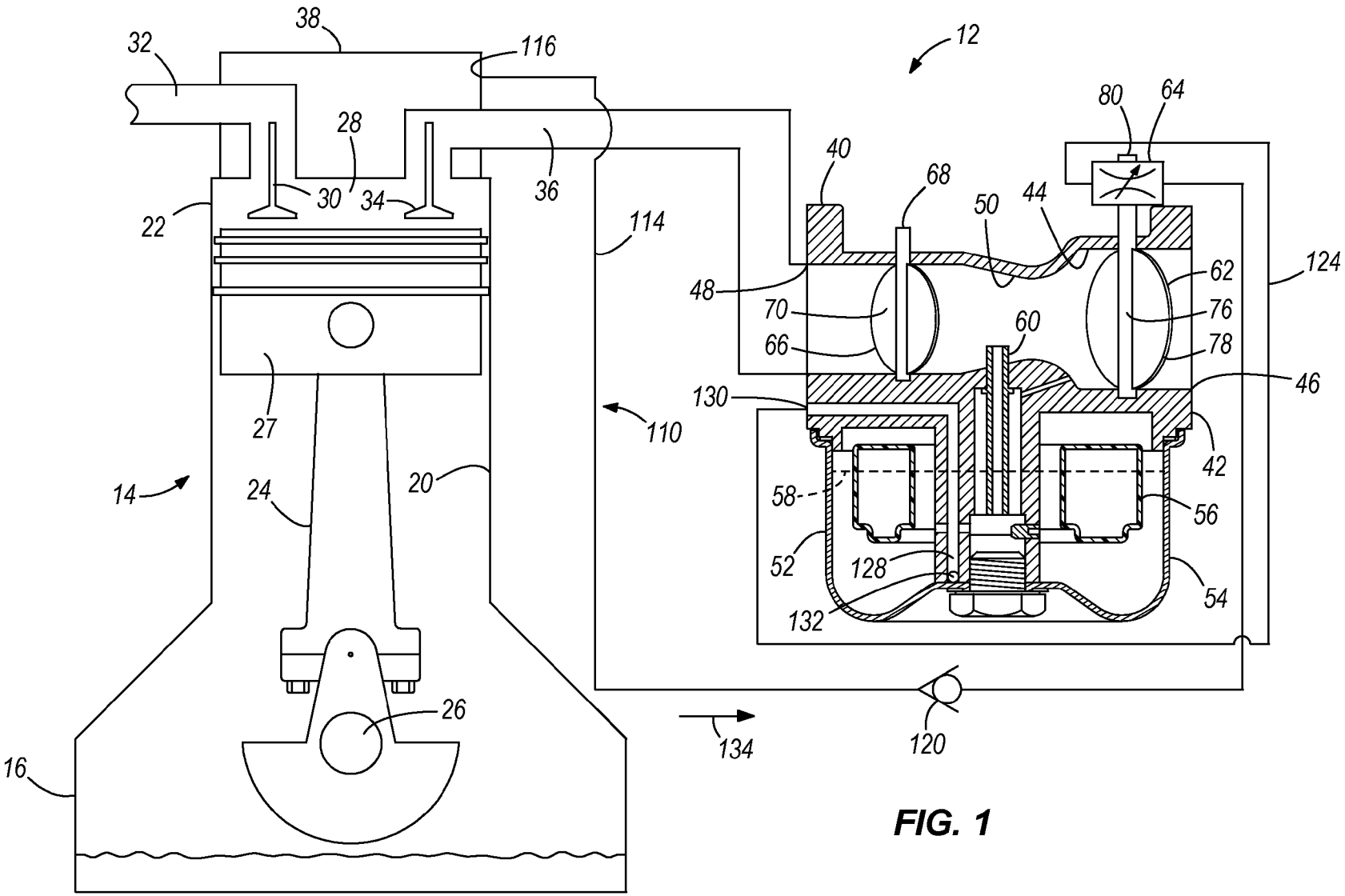
FIG. 1 is a schematic view of an internal combustion engine in one embodiment of the invention.

FIG. 1 illustrates an internal combustion engine 12. The internal combustion engine 12 can be used with any suitable piece of power equipment, such as a lawnmower, a snow thrower, a lawn trimmer, and the like. However, the invention described herein is preferably used on engines requiring additional starting assistance, such as snow thrower engines and engines powering standby generators. The internal combustion engine 12 includes a housing 14 (FIG. 2) having a crankcase 16, a cylinder 20, and a cylinder head 22. A connecting rod 24 and a crankshaft 26 are partially disposed in the crankcase 16, and a piston 27 is disposed in the cylinder 20. The connecting rod 24 interconnects the piston 27 and the crankshaft 26 such that the piston 27 reciprocates in the cylinder 20 to rotate the crankshaft 26. A combustion chamber 28 of the engine is formed between the piston 27 and the cylinder head 22.

Figure 7:
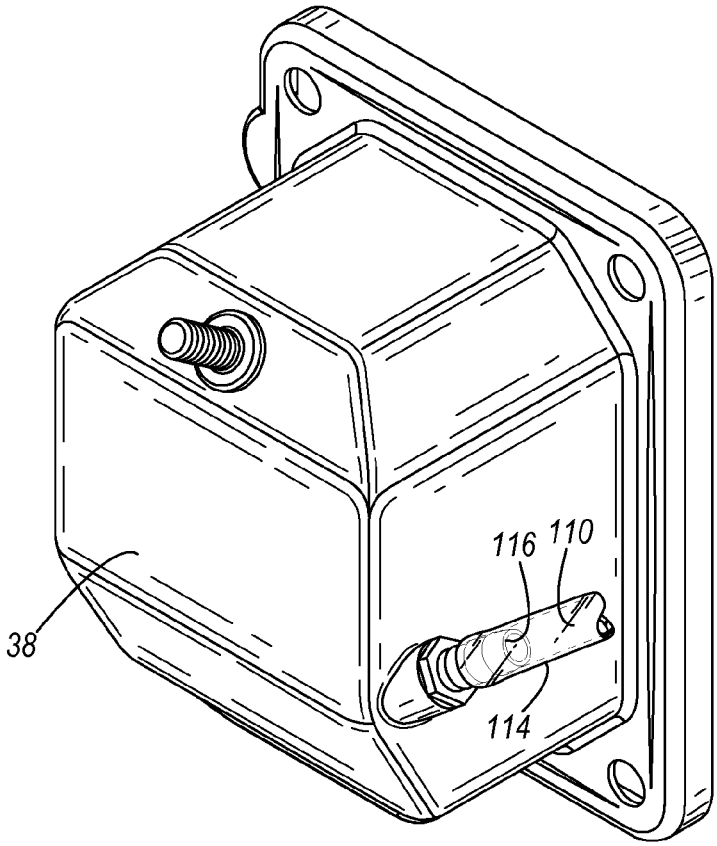
FIG. 7 is a perspective view of a valve cover of the engine of FIG. 1.
Figure 8:
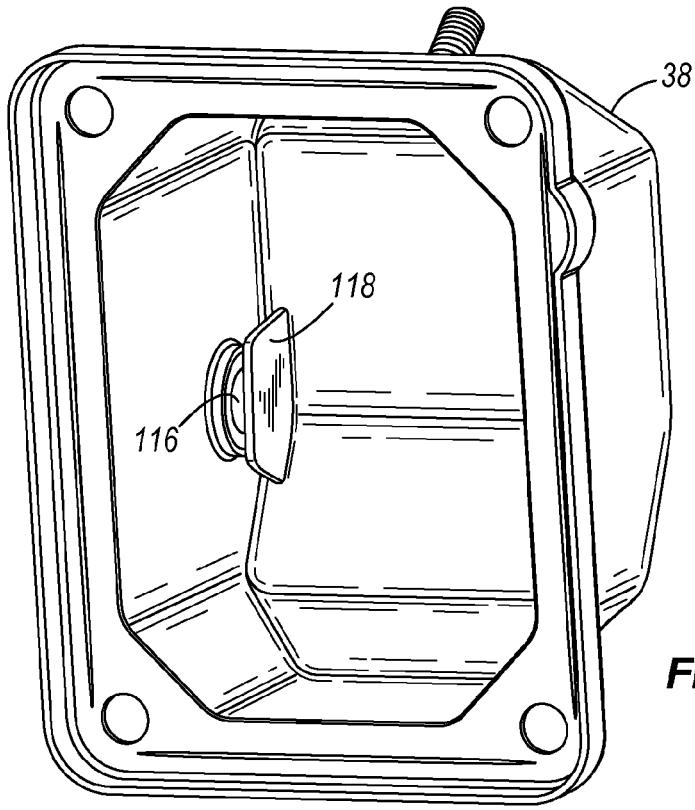
FIG. 8 is an alternative perspective view of the valve cover of FIG. 7.

The engine 12 further includes an exhaust valve 30 to control exhaust flow through an exhaust outlet 32 of the engine 12, and an intake valve 34 to control flow of a air-fuel mixture through an intake 36 of the engine 12 and into the combustion chamber 28. A valve cover 38, which is illustrated in more detail in FIGS. 7 and 8, is coupled to the cylinder head 22 to cover the intake valve 34 and exhaust valve 30 and to enclose a valve chamber of the cylinder head 22. Although the illustrated engine 12 includes only one cylinder 20 and one pair of valves 30 and 34 for the cylinder 20, in other constructions the engine can include any suitable number of cylinders and any suitable number of intake and exhaust valves for each of the cylinders.

With continued reference to FIG. 1, the engine further includes a carburetor 40 coupled to the intake 36 of the engine 12. The carburetor 40 includes a body portion 42 that defines an air intake or throat 44 having an inlet end 46, an exit end 48, and a venturi 50 between the inlet end 46 and the exit end 48. While not illustrated, an air cleaner, an air filter, or the like can be coupled to the inlet end 46 of the air intake 44. A fuel chamber 52 is coupled to the body portion 42 of the carburetor 40. The fuel chamber 52 includes a fuel bowl 54 and a float 56. As would be understood by one of skill in the art, the float 56 is used to regulate a fuel level 58 within the fuel bowl 54. A fuel nozzle 60 of the carburetor provides fluid communication between the fuel bowl 54 and the venturi 50 of the air intake 44.

The carburetor 40 further includes a choke valve 62, a priming valve 64, and a throttle valve 66. The throttle valve 66 includes a shaft 68 and a plate 70 coupled to the shaft 68 within the air intake 44 between the venturi 50 and the exit end 48. The shaft 68 and plate 70 are rotatable with respect to the body portion 42 of the carburetor 40 to regulate the air-fuel mixture that is supplied to the combustion chamber 28. An actuator 72 (FIG. 2), which includes a lever 74 in the illustrated construction, is coupled to the throttle valve shaft 68 to rotate the throttle valve 66. The lever 74 can be either manually or automatically operated.

Figure 2:
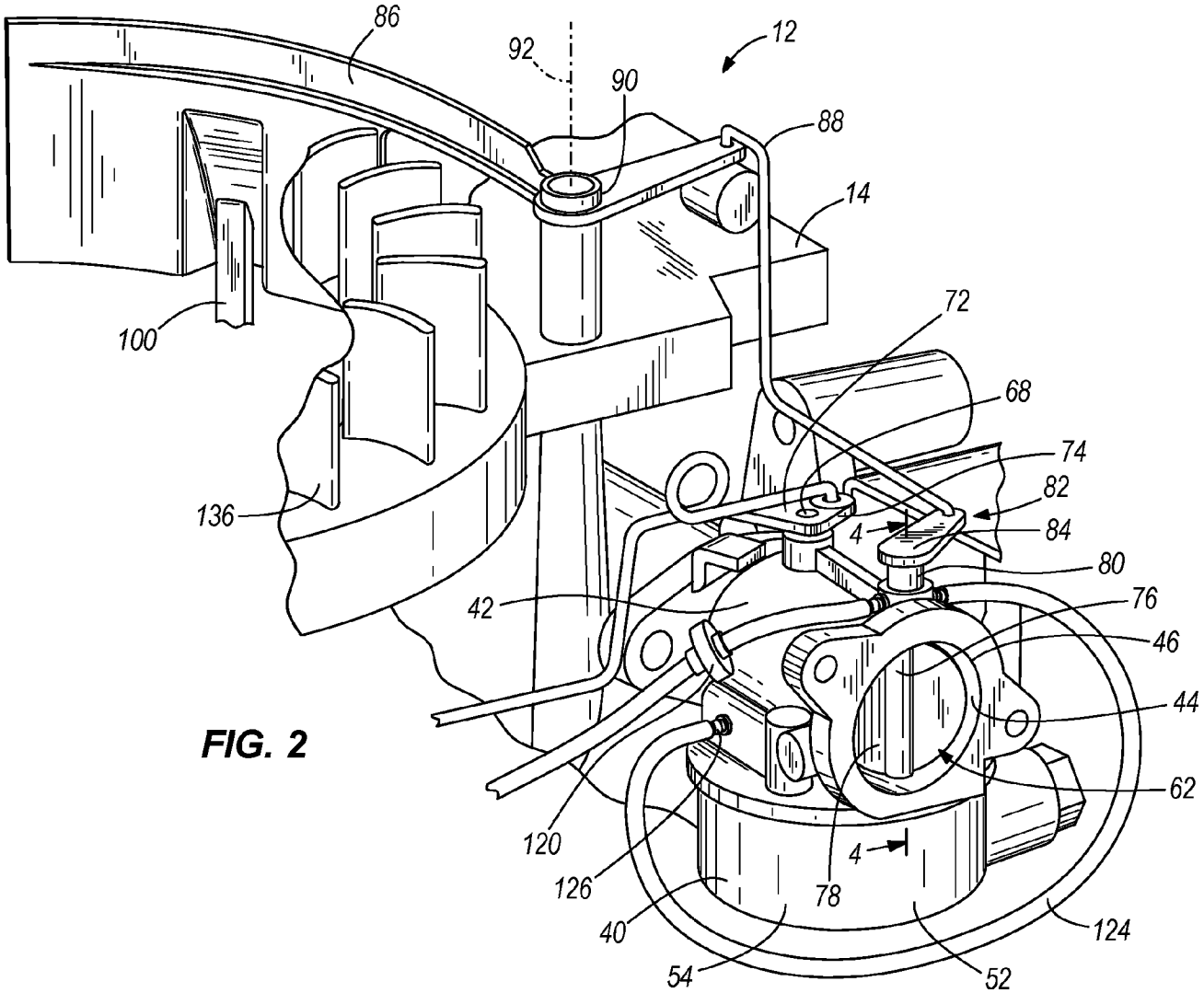
FIG. 2 is a perspective view of a portion of the engine of FIG. 1.

The choke valve 62 includes a shaft 76, and a plate 78 coupled to the shaft 76 within the air intake 44 between the venturi 50 and the inlet end 46 of the carburetor 40. As best seen in FIGS. 1 and 2, the choke shaft 76 includes an end portion 80 that extends through the body portion 42 of the carburetor 40. An actuator 82 is coupled to the end portion 80 of the choke shaft 76 to rotate the choke plate 78 with respect to the body portion 42 of the carburetor 40. In the construction illustrated in FIG. 2, the actuator 82 includes a lever 84 and an air vane 86 that is coupled to the lever 84 using a wire linkage 88. The air vane 86 is pivotally connected to the engine 12 at a pivot 90 such that the air vane rotates about an axis 92 to rotate the choke valve 62. While the illustrated choke actuator 82 is a mechanical actuator, in other constructions, such as the construction illustrated in FIG. 9, the actuator can be an electric actuator 94. The construction illustrated in FIG. 9 will be discussed in more detail below. Furthermore, although the actuators 82 and 94 of FIGS. 2 and 9, respectively, are activated without the operator's intervention, it should be understood that the choke actuator can also be a manual actuator that is opened and closed by the operator. For example, in some constructions, the choke actuator may include a manual sliding lever arm attached via a linkage to the lever 84 of FIG. 2.

Figure 3:
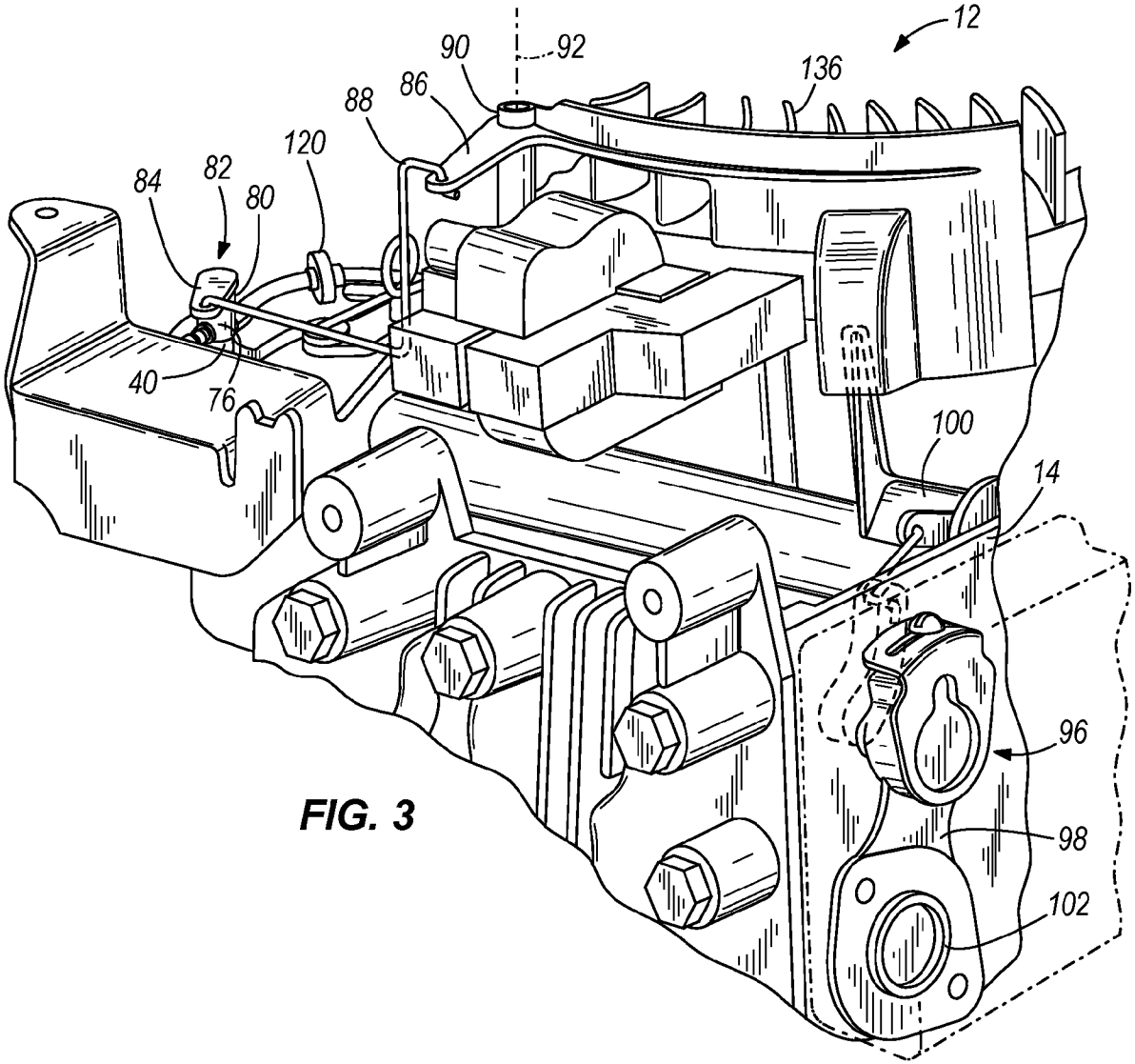
FIG. 3 is an alternative perspective view of the engine of FIG. 2.
Figure 4:
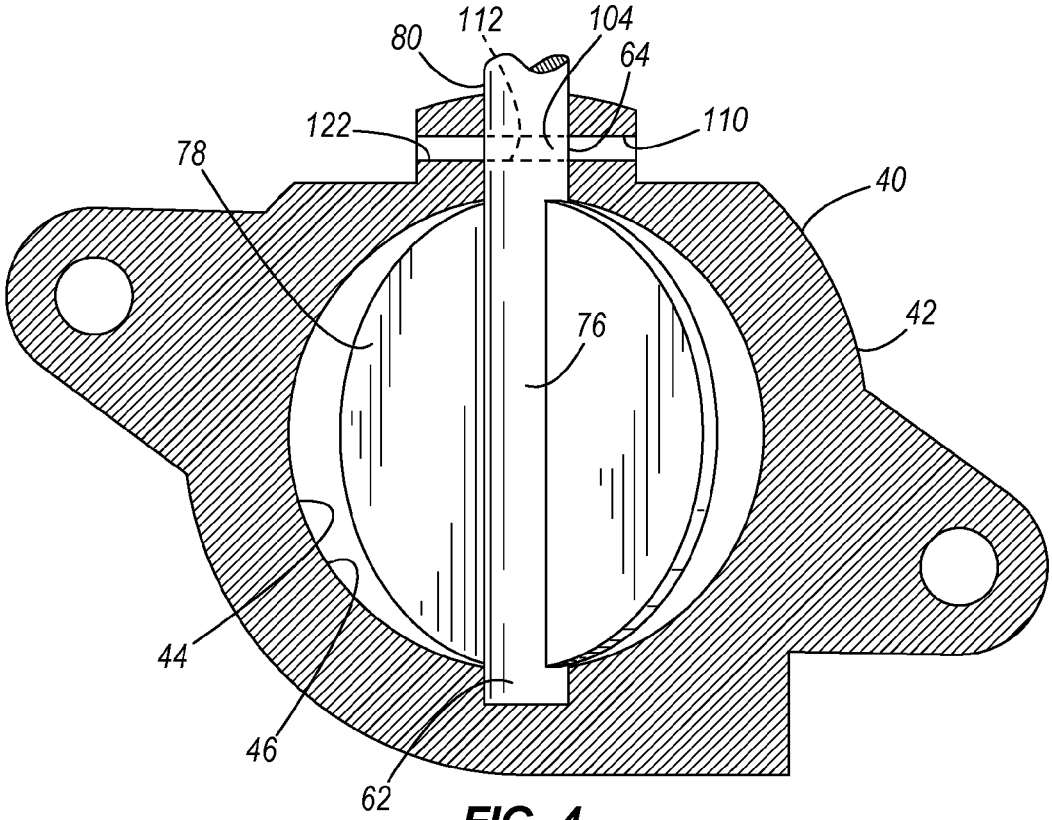
FIG. 4 is a cross sectional view of a carburetor of the engine of FIG. 2, taken along line 4-4 of FIG. 2, illustrating a choke valve in a closed choke position

A best seen in FIG. 3, the illustrated engine 12 includes a thermal responsive assembly 96. In the illustrated embodiment, the thermal responsive assembly 96 includes a thermal conductive element 98 and a stop lever 100. The thermal conductive element 98 includes an exhaust flange 102 that cooperates with an output of an exhaust manifold of the engine 12. Thus, the thermal conductive assembly 98 at least partially surrounds a path of exhaust gases from the engine 12, which places the thermally conductive assembly 98 in direct contact with the exhaust gas. The stop lever 100 is pivotally coupled to the engine housing 14 and is coupled to the thermal conductive element 98 such that the thermal conductive element 98 is operable to pivot the stop lever 100 with respect to the engine housing 14 in response to a sensed temperature of the engine exhaust gases. As best seen in FIGS. 3 and 4, the stop lever 100 is positioned adjacent the air vane 86. Stop lever 100 keeps the choke partially open during hot restarts of the engine 12.

Referring to FIGS. 1 and 4, the priming valve 64 is coupled to the choke valve 62 for movement with the choke valve 62. The priming valve 64 includes a portion 104 of the choke shaft 76 within a priming passageway 110 and an aperture 112 that extends through the choke shaft 76 within the priming passageway 110. In the illustrated construction, the priming valve 64 is integrally formed with the choke shaft 76 by forming the aperture 112 through the choke shaft 76. In other constructions, the priming valve can be alternatively coupled or directly coupled to the choke shaft 76 such that movement or actuation of the choke valve 62 also moves the priming valve. For example, in other constructions, the priming valve can include a plate, similar to the choke plate 78, that is mounted on the same shaft as the choke plate such that rotation of the shaft rotates both plates of the choke valve and the priming valve. In other constructions, the priming valve can be coupled to choke valve via a mechanical linkage.

Referring to FIG. 1, the priming passageway 110 includes a first portion 114 having an inlet 116 located within the valve cover 38 (FIGS. 7 and 8). As best seen in FIG. 8, a baffle 118 is located adjacent the inlet 116, inside of the valve cover 38, to inhibit oil and other particles from traveling through the inlet 116 while still allowing air and other gases to travel through the inlet 116. Although, in the illustrated construction the inlet 116 is formed in the valve cover 38, in other constructions, the inlet can be formed in the crankcase 16. Referring to FIGS. 1 and 2, the first portion 114 of the passageway 110 extends from the inlet 116 to the carburetor 40. A check valve 120 is disposed within the first portion 114 of the passageway 110 to inhibit a flow from the carburetor 40 toward the valve cover 38 or inlet 116. The first portion 114 of the passageway 110 is in fluid communication with a second portion 122 (FIG. 4) of the passageway 110 that is formed in the body portion 42 of the carburetor 40. As best seen in FIG. 4, the priming valve 64 is located within the second portion 122 of the priming passageway 110. Referring to FIGS. 1 and 2, a third portion 124 of the passageway is in fluid communication with the second portion 122 and the fuel chamber 52. The third portion 124 is coupled to the carburetor 40 using a coupling 126. The coupling 126 provides fluid communication between the third portion 124 and a priming passageway 128 of the carburetor 40. Referring to FIGS. 1 and 2, the illustrated priming passageway 128 of the carburetor 40 has an inlet 130 that receives the coupling 126 and an outlet 132 located below the fuel level 58 to provide fluid communication between the priming passageway 110 and the fuel bowl 54.

Figure 6:
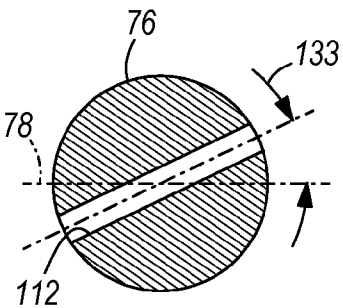
FIG. 6 is a cross sectional view of a choke shaft of the carburetor taken along line 6-6 of FIG. 5.

Referring to FIGS. 4 and 6, in the illustrated construction, the aperture 112 of the priming valve 64 extends through the center of the choke shaft 76 at an angle 133 with respect to the choke plate 78. The angle 133 is about 20 degrees in the illustrated construction. Accordingly, in the illustrated construction, the aperture 112 is aligned with the second portion 122 of the priming passageway 110 when the choke plate 78 is in the position illustrated in FIG. 4. FIG. 4 shows the choke plate 78 in a closed choke position. As would be understood by one of skill in the art, FIG. 4 illustrates just one possible choke position. In other constructions, the choke plate 78 can be rotated from the position illustrated in FIG. 4 to allow more air through the air intake 44 when the choke valve 62 is in a partial choke position depending on the type of choke used, engine temperature, or ambient temperature.

Referring to FIG. 1, in operation, particularly when the engine 12 is started cold (e.g., at a low ambient temperature) the choke valve 62 is placed in the closed choke position. In the illustrated construction, the choke valve 62 is automatically biased to the closed choke position by the actuator 82. In other constructions, the choke valve 62 can be manually placed in the closed choke position, such as by a user using a manual actuator. In the closed choke position, the choke plate 78 restricts the amount of air that can travel through the intake 44 thereby, enriching the air-fuel mixture that travels to the combustion chamber 28.

With the choke valve 62 in the closed choke position (FIG. 4) the aperture 112 of the priming valve 64 is aligned with the second portion 122 of the passageway 110 formed by the body portion 42 of the carburetor 40. Therefore, the priming valve 64 is automatically placed in an open primer position to allow fluid communication through the second portion 122 of the passageway 110 when the choke valve 62 is in the closed choke position. Although in the illustrated construction, the priming valve 64 is in the open primer position when the choke valve 62 is in the closed choke position, in other constructions, the priming valve can be in either the open primer position or a partially open primer position when the choke valve is in either the closed choke position or a partially closed choke position.

With the choke valve 62 in the closed choke position and the priming valve 64 in the open primer position, the crankshaft 26 is rotated to start the engine 12. As the crankshaft 26 rotates, the piston 27 reciprocates with respect to the cylinder 20. Reciprocation of the piston 27 creates pressure pulses that are vented through the inlet 116 of the priming passageway 110 formed in the valve cover 38.

Referring to FIGS. 1 and 8, the pressure pulses travel around the baffle 118 and through the inlet 116, into the priming passageway 110, and toward the relatively low pressure intake 36. The baffle 118 inhibits oil and other particles from traveling through the inlet 116 and into the priming passageway 110. The pressure pulses travel through the check valve 120 in the direction of arrow 134 and through the aperture 112 of the priming valve 64. After passing through the priming valve 64, the pressure pulses travel through the priming passageway 128 of the carburetor 40 and exit the passageway 128 through the outlet 132 that is below the fuel level 58. Thus, the pressure pulses force additional fuel through the fuel nozzle 60 and into the venturi 50 of the carburetor air intake 44 to enrich the fuel-air mixture.

After the engine 12 is started, the choke valve 62 is moved from the closed choke position toward the open choke position by the actuator 82. In the illustrated construction, the choke valve 62 is automatically moved to an open choke position by the actuator 82. When the engine is running, a fan 136 (FIG. 3) of the engine 12 rotates to produce a flow of air that generally increases as function of the running speed of the engine 12. At a predetermined running speed, the flow of air created by the fan 136 rotates the air vane 86 about the axis 92, clockwise in the construction and illustration of FIG. 2. Rotation of the air vane 86, rotates the choke lever 84, and thus the choke shaft 76, to move the choke valve 62 from the closed choke position (FIG. 4) to the open choke position (FIG. 5).

Figure 5:
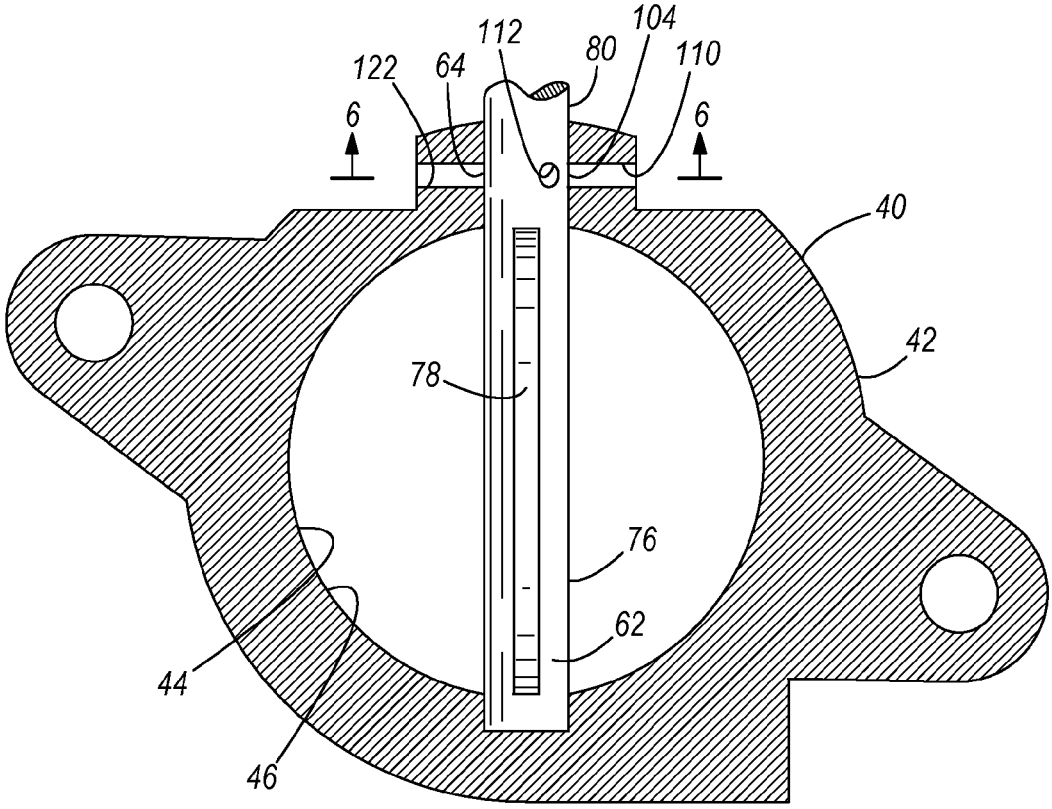
FIG. 5 is a cross sectional view of the carburetor of the engine of FIG. 2 illustrating the choke valve in an open choke position.

Referring to FIGS. 2 and 5, when the actuator 82 moves the choke valve 62 toward the open choke position, the actuator 82 also moves the priming valve 64 toward the closed primer position in order to substantially restrict the pressure pulses from entering the fuel chamber 52 and enriching the air-fuel mixture. The priming valve 64 is coupled to the choke shaft 76 by being integrally formed with the choke shaft 76. Accordingly, as the choke shaft 76 is rotated by the actuator 82 toward the open choke position, the aperture 112 also rotates to move the priming valve 64 toward the closed primer position. With the aperture 112 rotated out of alignment with the priming passageway 110, the choke shaft 76 substantially restricts the pressure pulses from traveling through the passageway 110 and into the fuel chamber 52 of the carburetor 40. Accordingly, when the engine 12 reaches the predetermined running speed, the choke valve 66 automatically moves to the open choke position and the priming valve moves to the closed primer position, thereby preventing further engine priming.

As best seen in FIG. 3, the illustrated engine 12 includes the thermal responsive assembly 96 that retains the choke valve 62 in the open choke position and the priming valve 64 in the closed primer position for hot restarts of the engine. Such a thermal responsive assembly is described in U.S. Pat. No. 6,990,969, the entire contents of which are hereby incorporated by reference herein. Referring to FIG. 3 of the present application, the exhaust flange 102 of the conductive element 98 is in contact with exhaust gases of the engine 12. The conductive element 98 senses a temperature of the exhaust gases. When the conductive element 98 senses that the temperature of the exhaust gases are above a predetermined temperature, the conductive element 98 pivots the stop lever 100 with respect to the engine housing 14. The stop lever 100 is pivoted to contact the air vane 86 in order to hold the air vane 86 in such a position that the choke valve 62 is held in the open choke position (FIG. 5). Therefore, the priming valve 64 is held in the closed primer position and both the choke and priming features are disabled for hot restarts of the engine. If the thermal responsive assembly 96 sense a temperature of the engine 12 below a predetermined temperature and the engine 12 is not running (e.g., cold start), the choke valve 62 and priming valve 64 automatically return to the closed choke position and the open primer position, respectively (FIG. 4).

Figure 9:
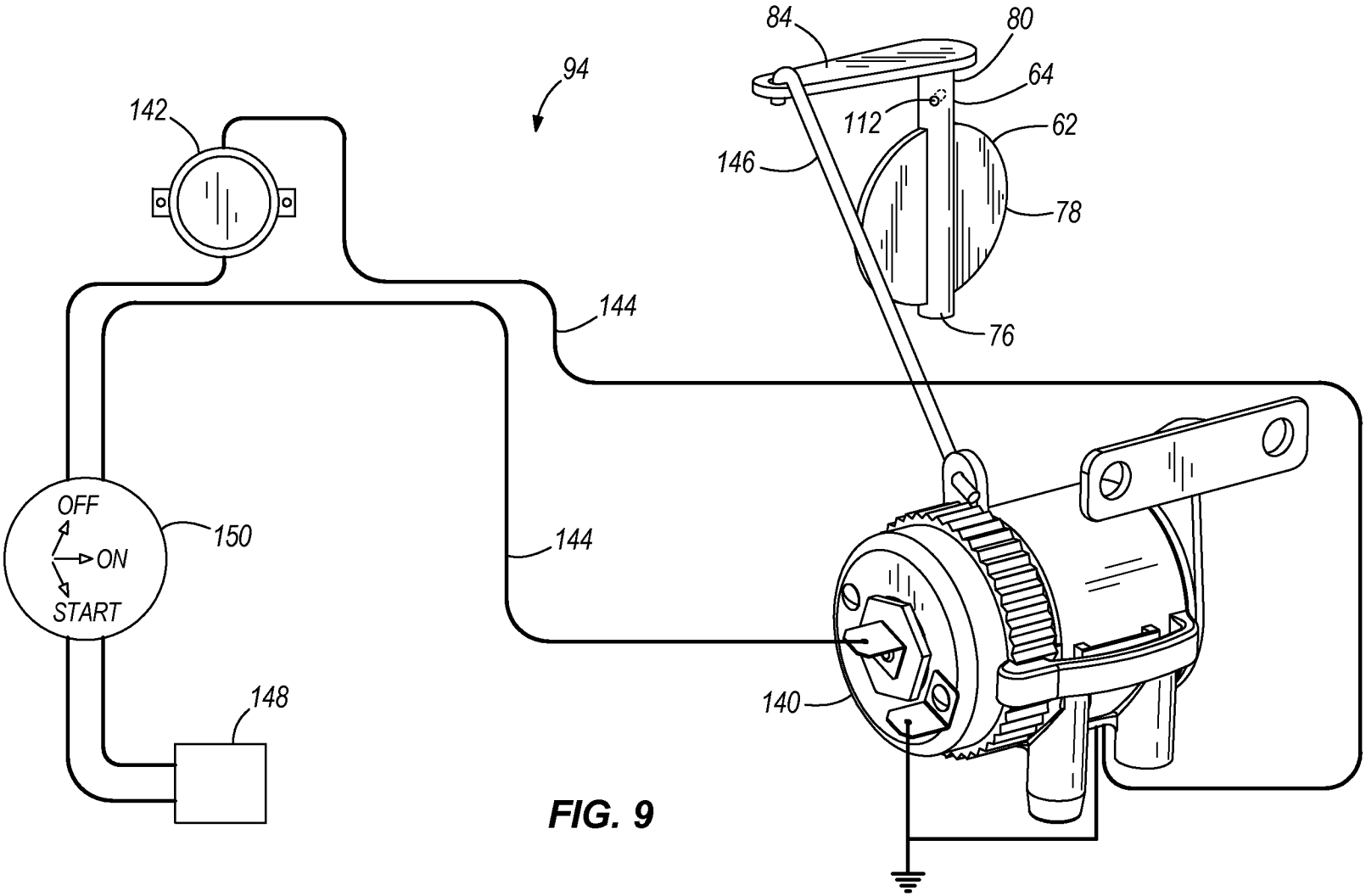
FIG. 9 is a schematic view of a choke valve and an actuator for the choke valve in a second embodiment of the invention.

Although the engine 12 of FIGS. 1-8 includes the choke actuator 82 that is an automatic mechanical actuator and the thermal responsive assembly 96 that is a mechanical thermal responsive assembly, in other constructions, the actuator and thermal responsive assembly can be electrical. FIG. 9 illustrates an example of such an automatic electrical actuator 94 for use with the engine 12, where like parts have been given like reference numbers. Such an actuator is described in U.S. Patent Application Publication No. 2009/0044777, the entire contents of which are hereby incorporated by reference herein. The actuator 94 of FIG. 9 includes a rotary solenoid 140 and a thermal switch 142 that is in electrical communication with the rotary solenoid 140 using wires 144. The actuator 94 is coupled to the choke lever 84 using a wire linkage 146. The actuator 94 further includes a battery 148 and a manual switch 150.

In operation, when the user starts the engine 12, particularly during a cold start of the engine, the rotary solenoid 140 is energized by the battery 148 when the user rotates the switch 150 to a START position or an ON position. The energized solenoid 140 rotates the choke valve 62 to the closed choke position (FIG. 4), which thereby places the priming valve 64 in the open primer position as discussed above. The energized solenoid 140 retains the choke valve 62 in the closed choke position until the thermal switch 142 senses a temperature of the engine 12 above a predetermined temperature. When the thermal switch 142 senses that the temperature of the engine 12 is above the predetermined temperature, the thermal switch 142 interrupts the power supply to the rotary solenoid 140 from the battery 148. Interrupting the power supply to the solenoid 140 causes the solenoid to rotate the choke valve 62 to the open choke position (FIG. 5), which thereby rotates the priming valve 64 to the closed priming position. Likewise, if the user starts the engine 12 when the temperature of the engine 12 is above the predetermined temperature (e.g., hot restart) the thermal switch 142 will prevent the solenoid from energizing and moving the choke valve 62 to the closed choke position and the priming valve to the open primer position.

Various features and advantages of the invention are set forth in the following claims.

What is claimed is:

1. An internal combustion engine comprising:

a cylinder;

a piston configured to reciprocate in the cylinder to generate a pressure pulse;

a carburetor including an air intake, a fuel chamber in fluid communication with the air intake, a choke valve having a choke shaft disposed in the air intake, and an actuator configured to move the choke valve between a closed choke position and an open choke position;

a passageway configured to direct the pressure pulse into the fuel chamber of the carburetor, at least a portion of the passageway extending through the choke shaft; and a priming valve at least partially located within the passageway, the priming valve configured to move between an open primer position that allows the pressure pulse to enter the fuel chamber through the passageway and a closed primer position that substantially restricts the pressure pulse from entering the fuel chamber through the passageway, wherein the priming valve is configured to move between the open primer position and the closed primer position by the actuator when the actuator moves the choke valve between the closed choke position and the open choke position, respectively.

2. The internal combustion engine of claim 1, wherein the priming valve is directly coupled to the choke valve such that movement of the choke valve between the closed choke position and the open choke position by the actuator moves the priming valve between the open primer position and the closed primer position, respectively.

3. The internal combustion engine of claim 1, wherein the choke shaft is rotatable by the actuator in order to move the choke valve between the closed choke position and the open choke position and the priming valve between the open primer position and the closed primer position, respectively.

4. The internal combustion engine of claim 3, wherein the choke shaft includes a portion located within the passageway, wherein the priming valve includes the portion of the choke shaft within the passageway and an aperture that extends through the portion of the choke shaft within the passageway such that the choke shaft substantially restricts the pressure pulse from entering the fuel chamber through the passageway and the aperture of the priming valve when the priming valve is in the closed primer position and the pressure pulse passes through the aperture of the priming valve and into the fuel chamber when the priming valve is in the open primer position.

5. The internal combustion engine of claim 1, wherein the carburetor includes a body portion that at least partially forms the air intake, and wherein the passageway is at least partially formed by the body portion of the carburetor.

6. The internal combustion engine of claim 1, wherein the engine includes a crankcase and a valve cover, wherein the passageway includes an inlet and an outlet, wherein the outlet is in fluid communication with the fuel chamber, and wherein the inlet is in fluid communication with one of the crankcase and the valve cover.

7. The internal combustion engine of claim 1, wherein the priming valve is configured to be in the closed primer position when the choke valve is in a partially open choke position.

8. The internal combustion engine of claim 1, wherein the fuel chamber includes a fuel bowl and a float, and wherein the carburetor includes a fuel nozzle configured to provide fluid communication between the fuel bowl and the air intake.

9. The internal combustion engine of claim 1, wherein the engine includes a valve cover, and wherein the passageway includes an inlet at least partially located within the valve cover.

10. The internal combustion engine of claim 1, wherein the choke valve includes a choke shaft rotatable by the actuator, and wherein the actuator includes a choke lever coupled to the choke shaft.

11. The internal combustion engine of claim 1, wherein the engine includes a fan configured to produce a flow of air that is a function of engine speed, wherein the actuator includes an air vane coupled to the choke valve, the air vane movable in response to the flow of air in order to retain the choke valve in the open choke position and the priming valve in the closed primer position.

12. The internal combustion engine of claim 11, wherein the engine includes a thermal responsive assembly in thermal communication with exhaust gases produced by the engine, the thermal responsive assembly configured to move in response to a temperature of the exhaust gases sensed by the thermal responsive assembly, and wherein the thermal responsive assembly is configured to retain the choke valve in the open choke position and the priming valve in the closed primer position when the thermally responsive member senses a temperature of the exhaust gases above a predetermined temperature.

13. The internal combustion engine of claim 1, wherein the actuator includes a rotary solenoid.

14. The internal combustion engine of claim 13, further comprising a thermal switch configured to respond to a temperature of the engine, wherein the thermal switch is in electrical communication with the rotary solenoid to cause the rotary solenoid to retain the choke valve in the open choke position and the priming valve in the closed primer position when the temperature exceeds a predetermined temperature.

15. A carburetor for use with an internal combustion engine having a cylinder and a piston configured to reciprocate in the cylinder to generate a pressure pulse, the carburetor comprising:

a body portion that at least partially defines an air intake;

a fuel chamber in fluid communication with the air intake;

a choke valve including a choke shaft disposed in the air intake, the choke valve configured to move between a closed choke position to restrict air flow through the air intake and an open choke position to increase air flow through the air intake relative to the closed choke position;

a passageway configured to direct the pressure pulse toward the fuel chamber of the carburetor, at least a portion of the passageway extending through the choke shaft; and a priming valve at least partially located within the passageway, the priming valve configured to move between an open primer position that allows the pressure pulse to enter the fuel chamber through the passageway and a closed primer position that substantially restricts the pressure pulse from entering the fuel chamber through the passageway, wherein the priming valve is coupled to the choke valve for movement with the choke valve such that movement of the choke valve between the closed choke position and the open choke position moves the priming valve between the open primer position and the closed primer position, respectively.

16. The carburetor of claim 15, wherein the priming valve is directly coupled to the choke valve.

17. The carburetor of claim 15, wherein the choke shaft is rotatable to move the choke valve between the closed choke position and the open choke position and the priming valve between the open primer position and the closed primer position, respectively.

18. The carburetor of claim 17, wherein the choke shaft includes a portion located within the passageway, wherein the priming valve includes the portion of the choke shaft within the passageway and an aperture that extends through the portion of the choke shaft within the passageway such that the choke shaft substantially restricts the pressure pulse from entering the fuel chamber through the passageway and the aperture of the priming valve when the priming valve is in the closed primer position and the pressure pulse passes through the aperture of the priming valve and into the fuel chamber when the priming valve is in the open primer position.

19. The carburetor of claim 15, further comprising an actuator coupled to the choke valve and operable to move the choke valve between the closed choke position and the open choke position, and wherein the actuator includes a lever coupled to the choke shaft.

20. The carburetor of claim 15, wherein the passageway is at least partially formed by the body portion of the carburetor.

21. The carburetor of claim 15, wherein the priming valve is configured to be in the closed primer position when the choke valve is in a partially open choke position.

22. The carburetor of claim 15, wherein the fuel chamber includes a fuel bowl and a float, and wherein the carburetor includes a fuel nozzle configured to provide fluid communication between the fuel bowl and the air intake.

23. An internal combustion engine comprising:

a crankcase;

a cylinder extending from the crankcase;

a cylinder head coupled to the cylinder;

a valve cover coupled to the cylinder head, the valve cover and the cylinder head defining therebetween a valve chamber;

a piston configured to reciprocate in the cylinder to generate a pressure pulse in at least one of the crank case and the valve chamber;

a carburetor including an air intake, a fuel chamber in fluid communication with the air intake, a choke valve disposed in the air intake, and an actuator configured to move the choke valve between a closed choke position and an open choke position;

a passageway having an inlet in fluid communication with one of the crankcase and the valve chamber and an outlet in fluid communication with the fuel chamber, the passageway configured to direct the pressure pulse into the fuel chamber of the carburetor; and a priming valve at least partially located within the passageway, the priming valve configured to move between an open primer position that allows the pressure pulse to enter the fuel chamber through the passageway and a closed primer position that substantially restricts the pressure pulse from entering the fuel chamber through the passageway, and wherein the priming valve is configured to move between the open primer position and the closed primer position by the actuator when the actuator moves the choke valve between the closed choke position and the open choke position, respectively.

24. The internal combustion engine of claim 23, wherein the choke valve includes a choke shaft rotatable by the actuator in order to move the choke valve between the closed choke position and the open choke position and the priming valve between the open primer position and the closed primer position, respectively.

25. The internal combustion engine of claim 24, wherein the choke shaft includes a portion located within the passageway, wherein the priming valve includes the portion of the choke shaft within the passageway and an aperture that extends through the portion of the choke shaft within the passageway such that the choke shaft substantially restricts the pressure pulse from entering the fuel chamber through the passageway and the aperture of the priming valve when the priming valve is in the closed primer position and the pressure pulse passes through the aperture of the priming valve and into the fuel chamber when the priming valve is in the open primer position.

* * * * *